US006145622A

United States Patent [19]

Clark, II

[11] Patent Number: 6,145,622

[45] Date of Patent: Nov. 14, 2000

[54] FLUID CHANGE SYSTEM

[75] Inventor: James E. Clark, II, Ojai, Calif.

[73] Assignee: C. H. & I. Technologies, Inc., Santa Paula, Calif.

[21] Appl. No.: 09/269,423

[22] PCT Filed: Sep. 26, 1995

[86] PCT No.: PCT/US95/12426

§ 371 Date: Mar. 26, 1999

§ 102(e) Date: Mar. 26, 1999

[51] Int. Cl.[7] ..... F16N 33/00

[52] U.S. Cl. ..... 184/1.5; 184/55.1; 417/118; 137/205

[58] Field of Search ..... 184/1.5, 55.1, 184/57, 58, 6.12; 417/118; 137/205

[56] References Cited

U.S. PATENT DOCUMENTS

| | | | |
|---|---|---|---|
| 4,938,315 | 7/1990 | Ohta et al. | 184/1.5 |
| 5,405,247 | 4/1995 | Goodman | 417/139 |
| 5,772,402 | 6/1998 | Goodman | 417/118 |
| 5,853,068 | 12/1998 | Dixon et al. | 184/1.5 |

*Primary Examiner*—David Fenstermacher
*Attorney, Agent, or Firm*—Christie, Parker & Hale, LLP

[57] ABSTRACT

A fluid change system (10) for use in changing fluid, i.e. motor oil from machinery. The system has a portable "suitcase" unit (12) and a unit (14) for recharging the suitcase unit. The suitcase unit (12) has a used fluid tank (22) for collecting and storing used fluid under vacuum, a new fluid tank (20) for storing and delivering new fluid, and a compressed air tank (18). A four-way valve (56) controls the inflow of used fluid into and new fluid out of the suitcase unit (12). The suitcase unit (12) has recharge ports (58, 60, 62, 64, and 66) through which the new fluid tank (20) will be refilled with new fluid and recharged with pressurized inert gas, the used fluid tank (22) will be emptied of used fluid and placed under a vacuum, and the compressed air tank (18) will be refilled with compressed air. A venturi operable by air from the compressed air tank (18) permits the user to put extra vacuum on the used fluid tank (22) as the need arises. The suitcase recharge unit (14) provides a station into which the suitcase portion (12) is engageable, and has a recharge port engagement manifold (190) with a number of transfer ports (192, 194, 196, 198, and 200) which are engageable with the recharge ports (58, 60, 62, 64, and 66) of the suitcase unit (12). A computer (212) controls the recharge sequence in which the operation of valves (202, 204, 206, 208, and 210) controls flow of fluids through the transfer ports (192, 194, 196, 198, and 200) from sources of compressed air (216), inert gas (218), vacuum (214), and new fluid (222), and a vessel (220) for used fluid collected from the suitcase unit (12).

25 Claims, 5 Drawing Sheets

FLUID CHANGE SYSTEM

BACKGROUND OF THE INVENTION

1. Field of the Invention

This invention relates to the field of fluid transfer, and more particularly to a do-it-yourself self-contained fluid change system for the removal of waste fluid materials, including, but not limited to various types of motor oils, hydraulic oils, transmission oils, greases and assorted coolants, from vehicles and machinery at their site, and delivery of new fluids to the vehicles and machinery in an improved manner wherein neither the collection of such waste materials nor the delivery of new materials requires the cleaning of the system after each use, and no loss of waste fluid is experienced, and this is all accomplished in a safe and effective manner.

2. Description of the Prior Art

Lubrication systems in the motors and engines of vehicles and machinery require that their lubricants, ie., oil and oil filters, be replaced periodically.

In the case of a motor vehicle, conducting an oil change has traditionally and continues to involve placing a large basin or funnel under the vehicles oil pan, removing the oil drain plug to allow the oil to drain by gravity therein, removing the old oil filter from the engine block, installing a new oil filter, replacing the oil drain plug, and refilling the motor with new oil. The waste oil collected must then be disposed of.

Due to a heightened awareness of the deleterious effects of motor oil on the environment, which is now classified and must be handled as a hazardous waste, the disposal of waste motor oil has become more regulated, and fewer people care to accept it. Another problem which has not been addressed is the issue of the old oil filter which retains waste oil. These old oil filter are regularly simply thrown away in landfills.

Partly because of these problems, specialized quick oil change facilities have gained in popularity in recent years. These quick lube facilities promise and generally deliver quick and convenient service and take possession of the waste oil and old oil filters. These facilities typically collect the waste motor oil in barrels or tanks, and which are then hauled off or pumped out by tank trucks. The charges to have an oil change carried out at these businesses typically exceeds the costs of the new oil and new oil filter used by a factor of three to six, or even more.

For many who either prefer to service their own vehicles, or cannot afford the relatively high cost of having oil changes carried out by specialized facilities, the problem of how to safely and legally deal with and dispose of the waste oil and waste oil filter remains a huge problem. In the case of the old oil filter, these continue to retain a considerable amount of waste oil even when drained, and used oil filters are typically not received along with waste motor oil. The do-it-yourselfer end user will typically buy new oil in cans or bottles, d rain the old oil into an oil drain pan, and either refill the new oil jugs with the collected waste oil, or collect it in some other container. The end user will still be faced with the problem of what to do with the collected waste oil, the old oil filter, and the residual oil in the oil collection pan. Again, due to the reluctance of others to received the waste oil, and the waste oil filter, many individuals do not properly dispose of the waste oil, and oil coated containers and filters, which results in environmental degradation. In point in fact, the amount of new motor oil sold exceeds the amount of waste oil collected by about sixty-nine (69%) percent. While some oil is burned up in vehicles, much of this waste oil ends up in landfills, is dumped illegally down storm drains, in lakes, and on vacant land, or is simply stored long term in containers.

For many machines, vehicles and aircraft, cooling fluids, hydraulic fluids and lubrication oils, etc., must be replenished and/or replaced periodically. In many cases, the changing of their fluid is difficult and messy. In the case of private aircraft, the oil change process is typically time consuming and messy. In the case of mining machinery and equipment, the mine environment tends to be dusty, making frequent oil and grease changes necessary, yet difficult to accomplish without introducing dust into the new fluids and grease being delivered to the machinery.

U.S. Pat. Nos. 4,193,487 and 4,095,673 to Takeuchi discloses combined new oil vending and waste oil removing devices which are designed to allow waste oil to be removed and new oil to be delivered to a vehicle.

U.S. Pat. No. 5,349,980 to Spiegel discloses a vehicle mounted service module for servicing a customer's vehicle by recovering waste fluids, i.e. old motor oil and specialty oils into a common waste fluid tank and delivery of the new fluids.

U.S. Pat. No. 5,370,160 to Parker discloses an apparatus for servicing a vehicle's transmission and the like by removing the old fluid and introducing new transmission fluid.

There accordingly remains a need for a system which is low in cost, which prevents waste fluid from getting into the environment, and which is easy to use in all situations.

BRIEF SUMMARY OF THE INVENTION

One object of the invention is to provide a fluid change system which is easy and convenient to use, yet can be provided at a cost not substantially greater than the cost of the motor oil being used.

Another object of the invention is to provide an oil change system which not only delivers new oil to the vehicle, but which also collects the waste oil being removed from the vehicle.

Yet another object of the invention is to provide a oil change system which has a portable unit which is rentable by a consumer, which after being used to remove waste motor oil and refill a vehicle with new motor oil is returned for recharging in a recharge unit, to ready the portable unit for immediate reuse by another user.

Still yet a further objective of the invention is to provide an oil change system which utilizes, in its portable unit, vacuum and compressed inert gas to remove and deliver the waste and new oil respectively.

A further object of the invention is to provide a fluid change system for machinery, vehicles and aircraft which permits the fluid change and/or replenishing to be conducted on site of the machinery, vehicle or aircraft in a clean and uncontaminating manner to the new fluid being delivered.

These and other objects of the invention are accomplished by providing a systems as follows:

A quick fluid change system for use in changing fluid, viz, oil, from a machine, vehicle or aircraft. The system has a portable (sometimes hereinafter referred to as a "suitcase" unit) and a recharge unit for the suitcase unit. The suitcase unit has a tank arrangement with a waste fluid tank for collecting and storing waste fluid under vacuum, a new fluid tank for storing and delivering new fluid, and a compressed air tank for holding compressed air. A four-way valve controls the inflow of waste fluid into, and new fluid out of the suitcase unit. The suitcase unit has recharge ports through which the new fluid tank will be refilled with new fluid and recharged with pressurized inert gas, the waste fluid tank will be emptied of waste fluid and placed under a vacuum, and the compressed air tank will be refilled with compressed air. A venturi operated by air from the compressed air allows the user to put extra vacuum on the waste fluid tank. These parts fit into a housing of the suitcase unit. The suitcase recharge unit provides a station into which the suitcase portion is engageable, and has a recharge port engagement manifold with a number of transfer ports which are engageable with the recharge ports of said suitcase unit. A computer controls the recharge sequence in which the operation of valves controls flow of fluids through the transfer ports from sources of compressed air, inert gas, vacuum, and new fluid, and a vessel for waste fluid collected from the suitcase unit.

DETAILED DESCRIPTION OF THE INVENTION

Figure 9:
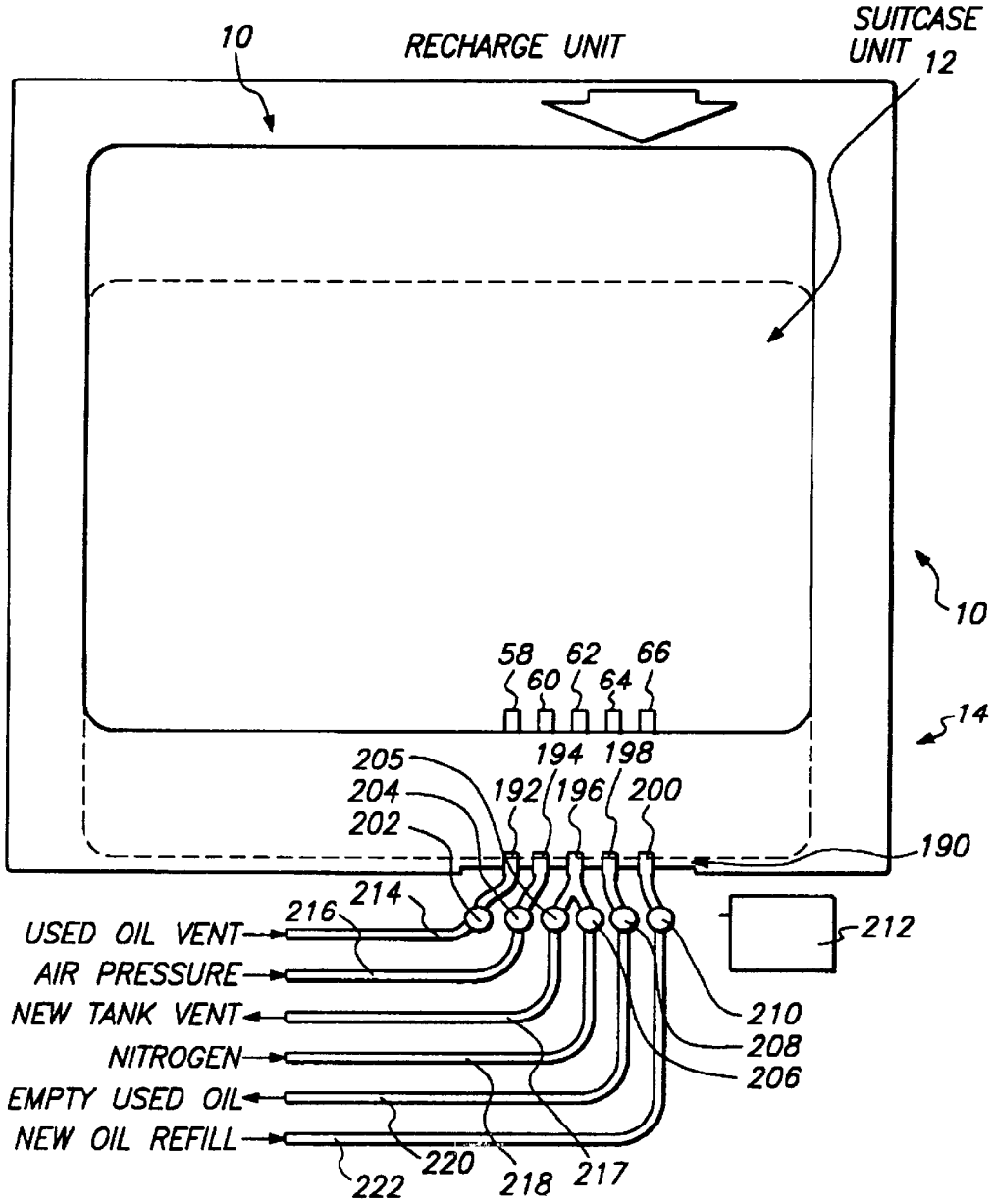
FIG. 9 is a top view showing the suitcase portion of the system being placed into a recharge unit of the invention.

Referring first to FIG. 9, the fluid change system of the invention 10, has two main parts—a suitcase portion 12 and a recharge portion 14. Hereinafter, the system will sometimes be described as the "do-it-yourself oil change system," for one of its primary implementations. However, the system can be used to change a wide variety of fluids for machinery, vehicles and aircraft. The suitcase portion 12 is the portion the do-it-yourselfer will rent, with a core charge, from an auto part supply house, discount store, or other retail establishment. The suitcase portion 12, when rented, will be completely charged with fresh motor oil, nitrogen gas, compressed air, and will have its waste oil tank evacuated to receive waste oil collected by a consumer from a vehicle. The end user will then use the suitcase portion 12 to carry out an oil and filter change on the vehicle as will be further described below. After the oil change is completed, the do-it-yourselfer will return the waste oil filled suitcase 12 to the place of renting for a refund of the core charge, and the suitcase portion 12 will be recharged in the recharge portion 14 and readied for immediate reuse by other customers. Having described the system 10 in overview, the various components, portions and operation of the system are now described in greater detail.

Figure 1:
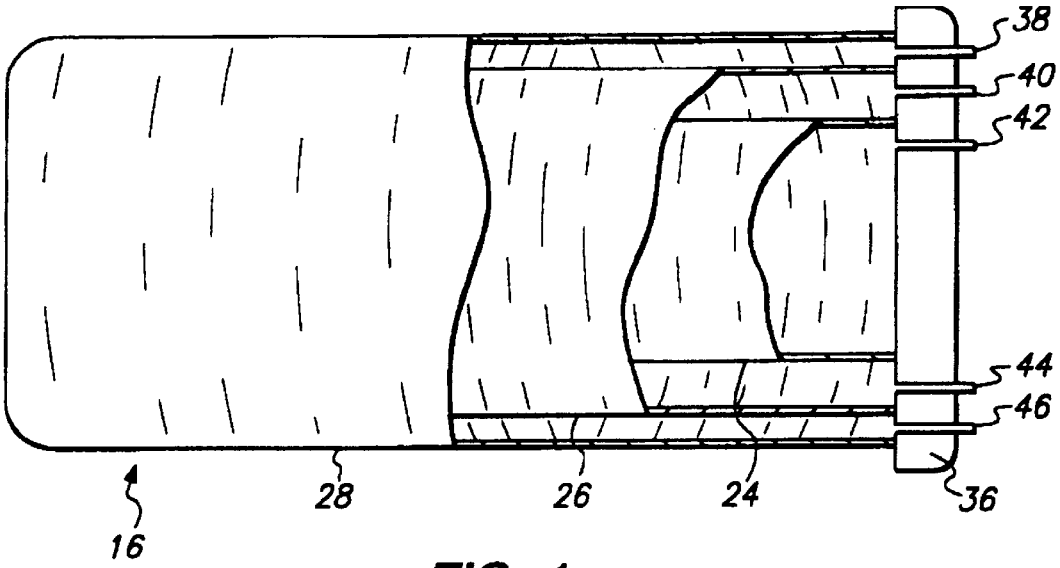
FIG. 1 is a top partially exposed view of the coaxial cylinders of the fluid change system of the invention, in the form of a do-it-yourself oil change system for automobiles.
Figure 2:
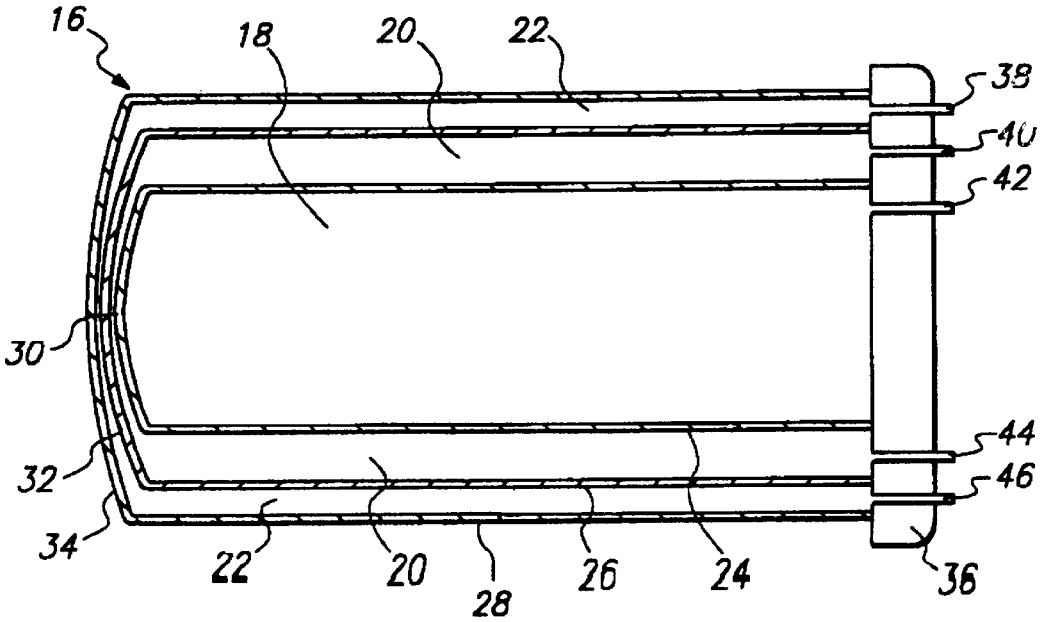
FIG. 2 is a exposed view of the coaxial cylinders of the do-it-yourself oil change system of the invention of FIG. 1.
Figure 3:
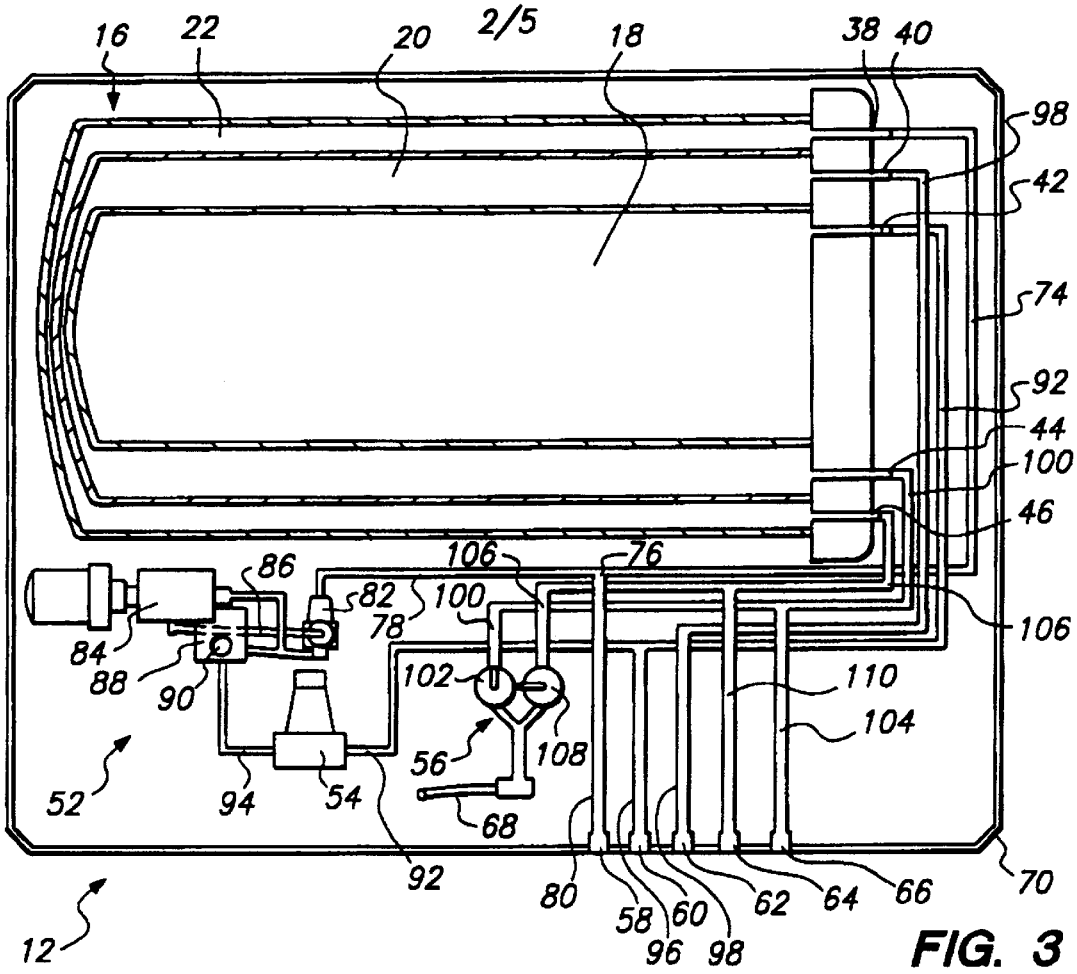
FIG. 3 is an exposed view of the do-it-yourself oil change system, showing the coaxial cylinders, the piping, venturi, ports and four-way valve.

The suitcase portion 12 of the invention has numerous components. Its tank assembly 16 is shown in FIGS. 1–3. It comprises three coaxial tanks 18, 20 and 22 with sidewalls 24, 26 and 28 and closed bottom ends 30, 32 and 34. The three tanks 18, 20 and 22 are placed one inside the other with their sidewalls 24, 26 and 28 and bottom ends 30, 32 and 34 spaced away from each other to allow for fluid flow. The open top portions of the three tanks are air-tightly attached to an end portion 36. For example, in the case of lightweight steel tanks 18, 20 and 22 and a metal sealing portion 36 (or plate), the tanks can be welded to the steel end portion at their upper end portions, with the inner tank 18 being welded first, followed by the middle tank 20, and then the outer tank 22. Alternately, the tanks can be threaded and/or attached with adhesives to the sealing portion 36. Other materials can be used to form the tanks 18, 20 and 22 and the end portion 36, i.e. aluminum, or high strength plastics. In one embodiment of the tank assembly 16, for oil changes of up to six quarts of oil, volumes of the coaxial tanks 18, 20 and 22 can be as follows, but can also have other dimensions.

For an example of tank dimensions that function well, the coaxial 18, 20, and 20 tanks can have the following dimensions. Compressed air tank 18, length—44.5 cm; diameter—15.25 cm, 7.57 liters; new fluid tank 20, length—53.35 cm, diameter—20.30 cm, 8.33 liters; and waste fluid tank 22, length—60 cm, diameter—25.4 cm, 8.33 liters.

The inner tank 18 is used to store compressed air (hereinafter "compressed air tank 18"). The middle tank 20 is used to store new oil (hereinafter "new oil tank 20"), and the outer tank 22 is used to store waste oil to be collected from the vehicle (hereinafter "waste oil tank 22"). The end plate 36 has five ports 38, 40, 42, 44 and 46 passing therethrough. Port 38 is used to gain access to waste tank 22 to not only relieve the vacuum when the system is being recharged and readied for use, but also to place a vacuum on it when needed by the user (i.e. when vacuum is lost by sucking excess air). Port 40 in the new oil tank 20 is used to charge it with an inert gas, such as nitrogen in order to propel the new oil out of the new oil tank 20. Port 42 opens into compressed air tank 18, and is used to charge it with compressed air. The compressed air is used to operate a venturi vacuum generating device, which can be used to place additional vacuum on the waste oil tank 22 as need may arise during the use of the suitcase portion 12 of the system 10 by the do-it-yourselfer. Port 44 gains access to the new oil tank 20 and is used for ingress and egress of new oil from the new oil tank 20 (ingress when the new oil tank 20 is being recharged, and egress when new oil is being discharged from the new oil tank 20 to a vehicle.) Port 46 is used to gain access to the used oil tank 22 and is used for ingress and egress of used oil from the used oil tank 22 (egress when the waste oil tank 22 is being emptied during the recharging process, and ingress when waste oil is being collected from the vehicle and into the waste oil tank 22.)

Figure 4:
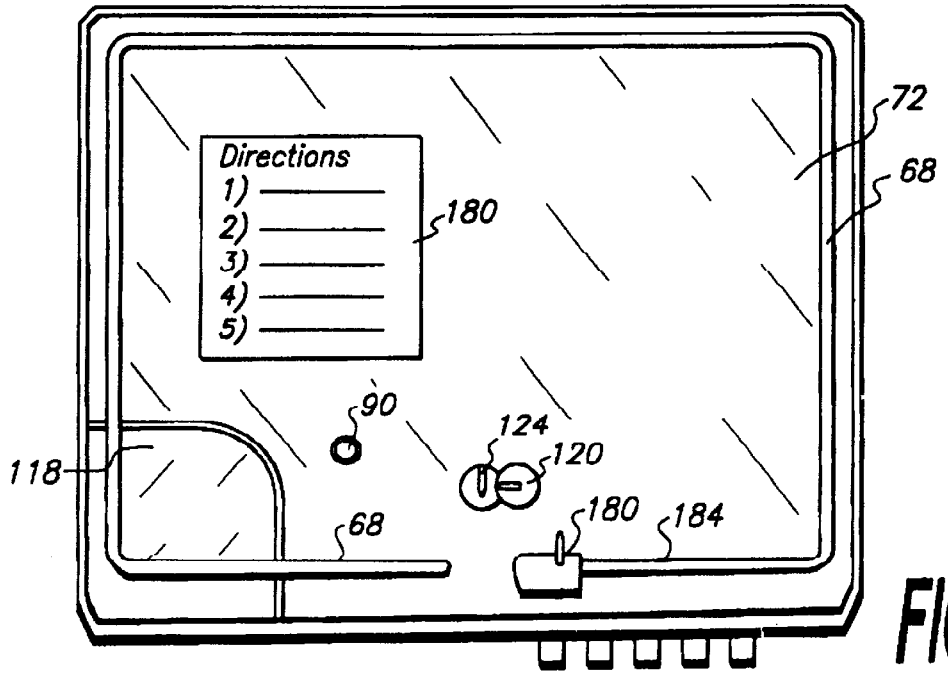
FIG. 4 is a top view of the suitcase portion of the do-it-yourself oil change system, with its lid removed to expose the portion visible to the consumer using the system.

Referring to FIGS. 3 and 4, the open suitcase portion 12 of the system 10 is shown. It has the tank assembly 16, piping (lines) from the ports 38, 40, 42, 44 and 46 of the tank assembly 16, a venturi vacuum assembly 52, an air regulator 54 for the venturi vacuum portion 52, a four-way valve assembly 56, five recharge access ports 58, 60, 62, 64 and 66, a used/new oil hose assembly 68, all contained in a case 70. The recharge access ports 58, 60, 62, 64 and 66 are preferably hooked together in a manifold arrangement, and remain closed until they are opened by engagement with mating fitting in the recharge unit 14. FIG. 3 shows the case 70 completely opened and with an access cover 72 (see FIG. 4) removed to reveal the various components. FIG. 4 shows the suitcase portion 12 with the access cover 72 on, but the case otherwise opened for use by the do-it-yourselfer.

Referring again to FIG. 3, connected to port 38 is vacuum line 74. At a juncture 76 it divides into a vacuum line 78 and vent line 80. The vent line 80 connects to recharge access port 58 (the waste oil vent recharge access port 58.) The vacuum line 78 connects though a blocking valve 82, through which air can pass, only when pressurized. The blocking valve 82 is connected to a venturi 84 by vacuum source line 86. Connected to port 42 (which opens into the compressed air tank 18) is compressed air line 92. Compressed air line 92 connects to the air pressure regulator 54, to drop the compressed air pressure from the 100 to 150 $lbs/in^2$ stored in the compressed air tank 18 to a lower pressure of about 70 $lbs/in^2$. Another line 94 carries the regulated pressurized air to the button valve 88. When the button valve 88 is opened by pressing an activation button 90, pressurized air will be allowed to flow to the venturi 84 and to a pilot on the blocking valve 82, thus opening it to the venturi 84, which puts a vacuum on vacuum line 86, through the now open blocking valve 82 and on the vacuum line 78 and to the vacuum line 74 to re-establish the vacuum on the waste oil tank 22. When the button 90 of the button valve 88 is not activated, compressed air will not flow through the venturi 84, and no additional vacuum will be placed on the waste oil tank 22 through the blocking valve 82. An offshoot 96 from the compressed air line 92 connects to the compressed air recharge access port 60.

A nitrogen oil recharge line 98 connects to port 40 which communicates with the new oil tank 20. The nitrogen recharge line 98 connects to nitrogen recharge access port 62, and is used for replenishing the new oil tank 20 with nitrogen during the recharge process. A new oil delivery line 100 connects the port 44 and new oil valve 102 of the four way valve 56, and also has a spur line 104 which connects to the new oil recharge port 66. A waste oil collection line 106 connects the port 46 and valve 108 of the four-way valve 56, and also has spur line 110 which connects to the waste oil recharge port 64.

The inventor has found that a waste oil tank 22 having an internal volume of about 8.33 liters works well to suction up to about 5.68 liters or less of waste motor oil.

The four-way valve unit 56 is designed in such a way that the waste oil must first be removed before the new oil can be delivered, and the function of the four-way valve unit 56 is described with reference with FIGS. 5–8. The four-way valve unit 56 comprises a waste oil ball valve 108 with a control handle 120 for controlling the flow of waste oil, and a new oil ball valve 102 with a control handle 124 for control the flow of new oil. The waste oil control valve 108 and new oil control valve 102 are located adjacent each other. The waste oil control valve 108 has a waste oil inlet 126, and a waste oil outlet 128 which is connected to the waste oil collection line 106. The new oil control valve 102 has a new oil inlet 130, which is connected to the new oil delivery line 100, and a new oil outlet 132. The waste oil inlet 126 and new oil outlet 132 are interconnected at a new/waste oil junction 134 of the four-way valve unit 56, to which the used/new oil hose assembly 68 is connected. The control handles 120 and 124 each have a stop portion 136 positioned thereon, which in conjunction with a waste oil stop 138 and a new oil stop 140 positioned on the four-way valve unit 56 limit the degree of rotation of the control handles 120 and 124, and thus the opening and closing of their control valves 108 and 102. The waste oil stop 138 is sized and shaped to allow the waste oil control handle 120 to rotate about one-half a turn, while the new oil stop 140 is sized and shaped to permit the new oil control handle 124 to rotate about one-quarter of a turn.

The waste oil control valve 108 and the new oil control valve 102, respectively, have rotation limiting disks 142 and 144 fixed on their handles 120 and 124. The limiting disks 142 and 144 are generally circular in shape, and have crescent-shaped indent portions 146 and 148. The valves 108 and 102 are spaced apart such that a portion of the perimeter of the circular portion of one limiting disk 142 or 144 can pass close to the crescent shaped indent portions 146 or 148. Exactly how these limiting disks 142 and 144 function to determine the order of opening of the valves 108 and 102 will now be described with reference to the FIGS. 5–8.

Figure 5:
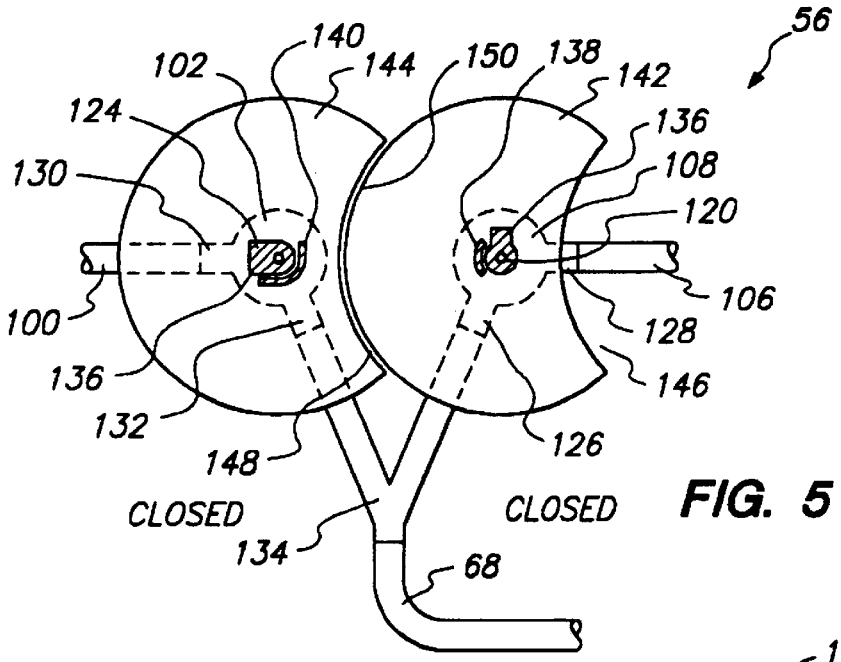
FIG. 5 is a top view of the four-way valve of the do-it-yourself oil change system, in its neutral position, with both the waste fluid and new fluid valves being shut off.

Referring to FIG. 5, the four-way valve 56 is shown with the waste oil valve 108 and new oil valve 102 closed. In this position, the perimeter portion 150 of the waste oil limiting disk 142 will ride adjacent to the crescent shaped indent portion 148 of the new oil limiting disk 144. The new oil valve handle 124 will thus be prevented from being moved from its closed position, and neither waste oil will flow through the waste fluid valve 108 into the waste fluid cylinder 22, nor will new oil will flow out of the new oil cylinder 20 through the new oil valve 102. This is the position of the four-way valve unit 56 when it is received by the end user from the retailer.

Figure 6:
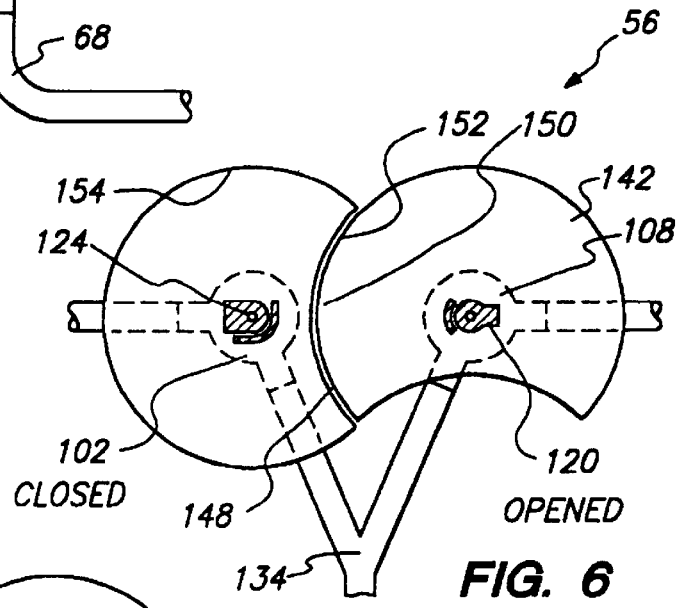
FIG. 6 is a top view of the four-way valve unit of FIG. 5, in its position to vacuum up waste oil into the waste oil cylinder.

FIG. 6 shows the four-way valve 56 with the waste oil valve 108 opened, with the waste oil valve handle 120 turned one-quarter turn clockwise from its closed position shown in FIG. 5 to an open position. The perimeter portion 152 of the waste oil limiting disk 142 will ride adjacent to the crescent shaped indent portion 148 of the new oil limiting disk 144 in this position, and continue to prevent the new oil valve 102 from being opened. After the oil hose assembly is placed into fluid contact with the vehicle (in a manner to be described further below), the waste oil valve handle 120 is operated as above described to suction up the waste oil from the oil pan of a vehicle.

Figure 7:
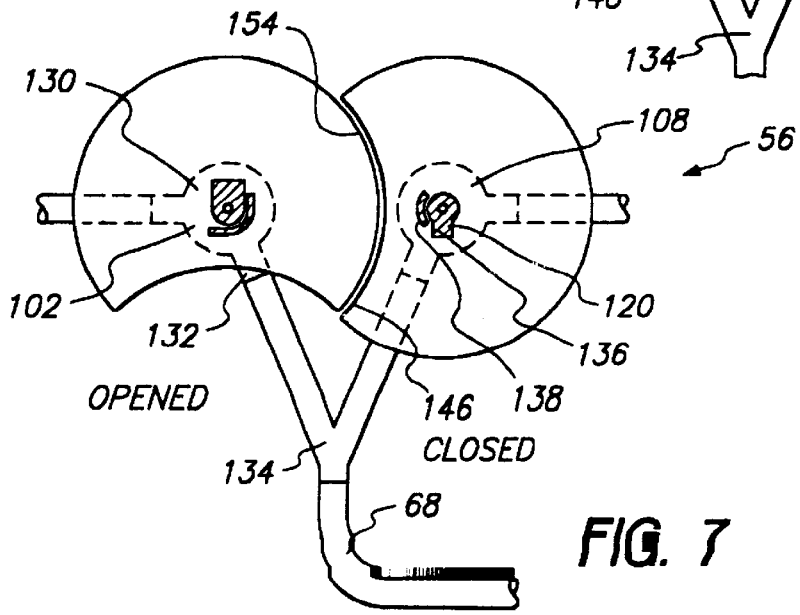
FIG. 7 is a top view of the four-way valve unit of FIG. 5, in its position to deliver new oil from the new oil cylinder.

FIG. 7 shows the four-way valve 56 with the waste oil valve 108 closed by turning its waste oil valve handle 120 an additional one-quarter turn from its open position of FIG. 6, to its closed position of FIG. 7. In this position, the waste valve handle stop 136 will impinge on the stop 138 on the valve, thereby preventing the waste oil valve 108 from being turn clockwise any further. If the oil filter (not shown) is to be replaced, it is at this point that the user can replace the old oil filter with a new one. The old oil filter can then be placed in a leakproof oil filter compartment 118 in the suitcase portion 72 (See FIG. 4). In the position shown in FIG. 7, the crescent shaped indent portion 146 of the waste oil limiting disk 142 will be in close proximity to the perimeter 154 of the new oil limiting disk 144, and allow it to be turned, for the first time, clockwise by one-quarter turn, to bring its perimeter portion 154 into the space of the crescent shaped indent portion 146 of the waste oil valve handle 120. This puts the new oil valve 102 in its open position, and new oil will flow from the new oil cylinder 20 through the new oil inlet 130, the new oil value 102, out the outlet 132, out the fluid junction 134, and out through the hose connected to the vehicle's motor.

Figure 8:
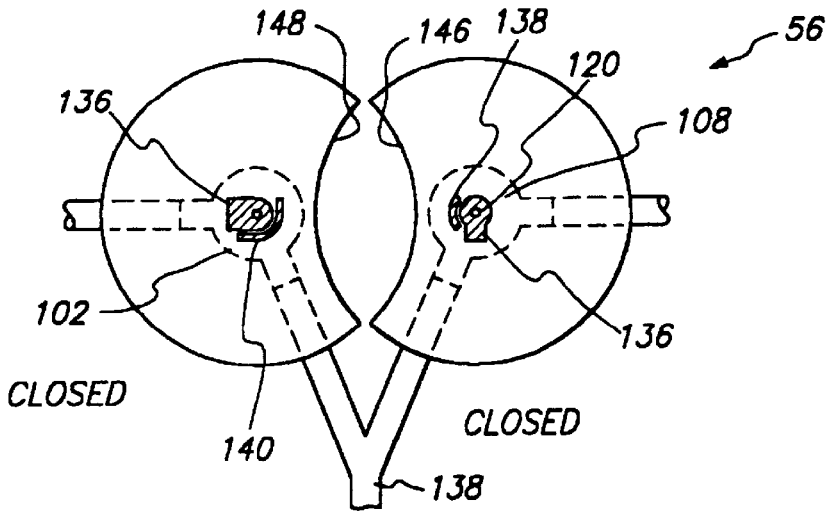
FIG. 8 is a top view of the four-way valve unit of FIG. 5, in its position after the waste oil has been vacuumed up and before the new oil is delivered.
Figure 10:
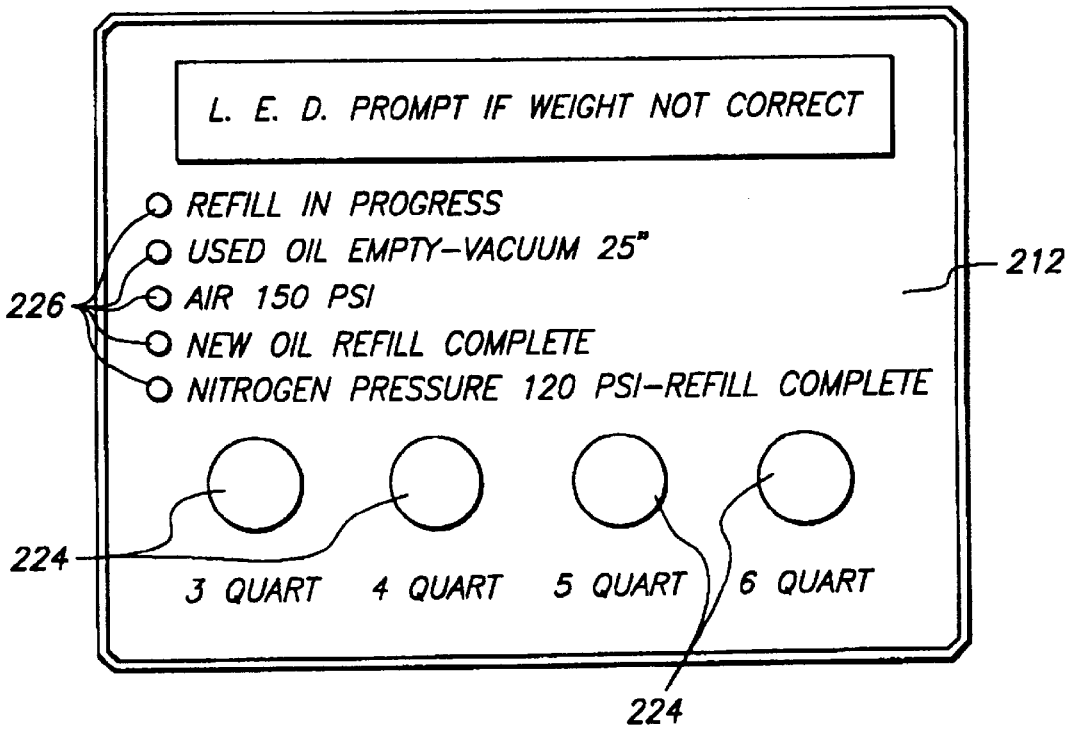
FIG. 10 is a front view of a control panel of the recharge unit.

After the desired amount of new oil is delivered to the motor of the vehicle, the new oil valve 102 will be turned off by turning it one-quarter turn counterclockwise, as best shown in FIG. 8, so that the crescent shaped indent portions 146 and 148 face each other.

Referring again to FIG. 4, the suitcase portion has a pocket portion 118 for storing the used oil filter. For this purpose, an easily sealable leakproof bag (not shown) can be provided into which the oil filter will be placed so that leakage of oil from the oil filter will not soak the inside of the suitcase 12. The new oil valve handle 124 and waste oil valve 120 operate as described above. An instruction panel 180 describes the operation of the device. The used/new oil hose assembly 68 is accessible to the do-it-yourselfer and has a valve 182 at its free end 184. The valve can either be fixed to a flexible dipstick suction tube which is designed to pass down into the oil dipstick opening to remove the oil remaining at the bottom of the vehicle's oil pan, or can drain directly from the do-it-yourselfer's oil drain pan.

Once connected to the vehicle to gain access to the vehicles oil system, system will be operate d by turning the four-way valve 56 in the proper sequence to first evacuate waste oil from the vehicle, replace the old oil filter with a new oil filter, and refill the empty crankcase with fresh oil. During the process of removing waste motor oil from the vehicle, sometimes air may be drawn in, resulting in a loss of vacuum in the waste oil tank, before all of the waste oil is removed. The compressed air tank 18 stores sufficient compressed air to operate the vacuum generating venturi 84, which when turned on by the push button 90 will place a vacuum on the waste oil container 22, two or three times on a single charge of compressed air. In cases where a dipstick suction tube is used, it can be used to evacuate oil from the bottom of the old oil filter before it is placed in the leakproof bag and into the compartment 118 of the suitcase portion 12.

After the do-it-yourselfer has completed the oil change, the used/new oil suction hose 68 will be disconnected from the vehicle and placed back in the suitcase 12, along with the old oil filter. The suitcase 12 will then be closed, and returned to the retailer for a refund of the core charge. The suitcase portion 12 can then be readied for reused by another user by removing the old oil filter from its compartment 118 and placing it in a recharge unit 14, as best shown in FIG. 9. The recharge unit 14 is designed such that the suitcase unit 12 will slide between an unengaged position, shown in solid lines, and the engaged recharge position, shown in phantom lines. The recharge unit 14 has a manifold 190 which has mating fitting 192, 194, 196, 198 and 200 which are sealably engageable with the recharge ports 58, 60, 62, 64 and 66, respectively, and which open them. Fittings 192, 194, 198 and 200 each have a solenoid activated valve 202, 204, 208 and 210. In the case of fitting 196, it diverts into two solenoid activated valves 205 and 206. The valves 202, 204, 205, 206, 208 and 210 are connected to a computer unit 212, which controls the automated recharge sequence. Valve 202 is connected to a used oil vent/vacuum line 214, which is used to vent a vacuum on the waste oil tank 22 while the waste oil is drained therefrom. Valve 204 is connected to air pressure line 216, which is used to put compressed air into the compressed air tank 18. Valve 205 is connected to a venting line 217 to allow air to vent out of the new fluid tank 22 when it is being filled with new fluid. While a venting line 217 and valve 205 are not absolutely necessary, they do aid in quicker refilling by reducing back pressure. Valve 206 is connected to compressed nitrogen line 218, which is used to place the new oil under nitrogen pressure. Valve 205 is closed when valve 206 is opened. This nitrogen gas pressure provides the motive force to move the new oil out of the new oil tank 20 to the vehicle. Valve 208 connects to another vacuum line 220, which is used to suction the waste oil out of the waste oil container 22. During the suctioning of waste oil out of the container, the used oil vent line 214 and valve 202 remain open. During the process of placing a vacuum on the now empty waste oil tank 22, the used oil line 214 and valve 202 will remain closed. Valve 210 is connected to the new oil refill line 222, and is used to recharge the new oil tank 20.

The recharge unit computer 212 allows the worker to select whether the portable suitcase unit 12 will be set up to deliver 3, 4, 5 or 6 quarts of new oil, by pressing selection buttons 224. Lighted progress buttons 226 will indicate to the worker the progress of the recharge sequence. When the suitcase unit 12 is complete recharged and ready for reuse, an audible or visual signal will be given, and the unit can be immediately reused. The recharge unit computer will activate the valves 202, 204, 205, 206, 208, and 210 and the delivery of pressurized air, nitrogen gas, new oil, vacuum to evacuate the waste fluid and to place a vacuum on the waste fluid tank 18 in the proper sequence, in a fully automated process. The suitcase portion can be readied for reuse very quickly.

One advantage of this do-it-yourself oil change system is that it can be made available at a cost which is not significantly higher than the purchase price of oil in quart containers, but less expensively than the cost of an oil change at a service station or a quick oil change facility. Another advantage is the cleanliness and simplicity of the system, which will prevent spillage of new or waste oil or the dumping of waste oil, which is a common but serious problem with present day do-it-yourself oil changes. Yet another advantage afforded by the system is that since it is an integrated waste oil collection and new oil delivery system, the problem of the dumping and disposal of waste oil by the end user is obviated.

Again, although the system has been described with respect to conducting a motor oil change or a motor vehicle by a do-it-yourself, the system can be employed to carry out oil changes and changes of other fluids, i.e. hydraulic fluids, coolants, or other chemicals in a machine, for example in mining equipment in a mine, in an aircraft on the tarmac, or machinery in factory, i.e. a printing press, as well as other uses.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A fluid change system for changing fluid in a fluid utilizing device comprising:

a tank arrangement having a used fluid tank adapted to store used fluid at a low pressure, a new fluid tank adapted to store new fluid and a compressed gas, and a compressed air tank;

a plurality of recharge ports connected with recharge piping to said tank arrangement through which (a) said new fluid tank is refilled with new fluid and recharged with pressurized gas; (b) said used fluid tank is emptied of waste fluid and is placed under a vacuum; and (c) said compressed air tank can be refilled with compressed air, said plurality of ports having valves to control ingress and egress of fluid and air therethrough;

a hose for evacuation of used fluid from and delivery of new fluid to the fluid utilizing device;

a control valve means connected by pipes to said new fluid tank, to said used fluid tank, to said compressed air tank, and to said hose, said control valve means being adapted to allow a user to selectively (a) open a pipe between said waste fluid tank and said hose to permit waste fluid to be evacuated from the fluid utilizing device, and (b) open a pipe between said new fluid tank and said hose to permit new fluid to be delivered to the fluid utility device; and a venturi which is connected to said compressed air tank and to said waste fluid tank, and operable by a valve means to permit a user to place a vacuum on said waste fluid tank.

2. The fluid change system of claim 1, wherein said waste fluid tank, said new fluid tank, and said compressed air tank are placed coaxially one inside the other.

3. The fluid change system of claim 1, wherein said hose for evacuation of used fluid and delivery of new fluid is connected to a flexible tube.

4. The fluid change system of claim 1, further comprising a connector valve for connection to said hose for engagement to a device undergoing a fluid change.

5. The fluid change system of claim 1, wherein said control valve means comprises a waste fluid valve and a new fluid valve, said two valves being positioned adjacently and each having a circular disk plate attached thereto and lying generally on a same plane, each said two circular disk plates having a crescent shaped indent portion removed, such that the position of said two circular disk plates will not allow the two adjacent valves to be opened simultaneously, and said circular disk plates requiring that said waste fluid must be turned on, and then off, before said new fluid can be turned on, and then off, to thereby control the sequence of collection of waste fluid from and delivery of new fluid to a fluid utilizing device.

6. The fluid change system of claim 1, further comprising a blocking valve to prevent loss of compressed air from said compressed air tank.

7. The fluid change system of claim 1, wherein said compressed gas is an inert gas selected from the group consisting of nitrogen, carbon dioxide, and helium.

8. The fluid change system of claim 1, wherein tank arrangement, said plurality of ports and piping, said control valve means, and said venturi are all contained in a housing portion to establish a portable unit.

9. The fluid change system of claim 8, further comprising a recharge station into which the portable unit is engageable, said recharge station comprising:

a recharge port engagement manifold having a number of transfer ports which are engageable with said recharge ports of said portable unit, and when so engaged open up said valves of said recharge ports;

a plurality of valves for controlling flow of fluid through said plurality of transfer ports;

sources of compressed air, inert gas, vacuum, and new fluid, and a container for waste oil collected from said portable unit; and a computer which controls a recharge sequence of said portable unit during which waste fluid is evacuated from the waste oil tank and it is placed under vacuum, said compressed air tank is refilled with compressed air, and said new fluid tank is refilled with new fluid and pressurized with inert gas to ready said portable unit for reuse.

10. A quick fluid change system for changing fluid in a fluid utilizing device comprising a portable unit and a recharge unit:

said portable unit comprising;

a tank arrangement having a used fluid tank adapted to store used fluid at a low pressure, a new fluid tank adapted to store new fluid and a compressed inert gas, and a compressed air tank;

a plurality of recharge ports with valve means connected with piping to said tank arrangement through which (a) said new fluid tank is adapted to be refilled with new fluid and recharged with pressurized inert gas, (b) said used fluid tank is adapted to be emptied of used fluid and placed under vacuum, (c) and said compressed air tank is adapted to be refilled with compressed air, said valve means of said recharge ports controlling the ingress and egress of materials therethrough;

a hose for evacuation of used fluids from and delivery of new fluid to the fluid utilizing device;

a venturi which is connected to said compressed air tank and to said used fluid tank, and operable by a valve means to permit a user of the quick fluid change system to put extra vacuum on said used fluid tank; and a housing portion into which said tank arrangement, said plurality of recharge ports and valve means, and said venturi are located;

said recharge portion comprising a station into which said portable unit is engageable;

a recharge port engagement manifold having a number of transfer ports which are engageable with said recharge ports of said portable portion and when engaged open up said valve means of said recharge ports;

a plurality of valves for controlling flow of fluid through said plurality of transfer ports;

sources of compressed air, inert gas, vacuum, and new fluid, and a container for the used fluid collected from said used fluid tank of said portable unit; and a control means which controls a recharge sequence of said portable unit during which waste fluid is evacuated from said used fluid tank and it is placed under vacuum, said compressed air tank is refilled with compressed air, and said new fluid tank is refilled with new fluid and inert gas to ready said portable unit for reuse.

11. The quick fluid change system of claim 10, wherein each used fluid tank, said new flue tank, and said compressed air tank are placed coaxially one inside the other.

12. The quick fluid change system of claim 10, further comprising a flexible dipstick fluid tube connected to said hose.

13. The quick fluid change system of claim 10, further comprising a connector valve connected to said hose for engagement to the device undergoing a fluid change.

14. The fluid change system of claim 10, wherein said control valve means comprises a waste fluid valve and a new fluid valve, said two valves being positioned adjacently and each having a circular disk plate attached thereto and lying generally on a same plane, each said two circular disk plates having a crescent shaped indent portion removed, such that the position of said two circular disk plates will not allow the two adjacent valves to be opened simultaneously, and said circular disk plates requiring that said waste fluid must be turned on, and then off, before said new fluid can be turned on, and then off, to thereby control the sequence of collection of waste fluid from and delivery of new fluid to a fluid utilizing device.

15. The quick fluid change system of claim 10, further comprising a blocking valve to prevent loss of compressed air.

16. The quick fluid change system of claim 10, wherein said inert gas is selected from the group consisting of nitrogen, carbon dioxide, and helium.

17. The quick fluid change system of claim 10, wherein the fluid is motor oil and the device is a vehicle undergoing an oil change.

18. A quick oil change system for use in changing oil from a machine, comprising:

a tank arrangement with a used oil tank for storing waste oil and vacuum, a new oil tank for storing new oil and compressed inert gas, and a compressed air tank for holding compressed air;

a plurality of recharge ports connected with recharge piping to said tank arrangement through which (a) said new oil tank is adapted to be refilled with new oil and recharged with pressurized inert gas, (b) said used oil tank is adapted to be emptied of waste oil and placed under a vacuum, and (c) said compressed air tank is adapted to be refilled with compressed air, said plurality of recharge ports having valves to control the ingress and egress of fluids and air therethrough;

a hose for evacuation of used oil from and delivery of new oil to the machine;

a control valve means connected by pipes to said new oil tank, to said used oil tank, and to said compressed oil tank, said control valve means being adapted to allow a user to selectively (a) open a pipe between said waste oil tank and said hose to permit waste oil to be evacuated from the vehicle, and (b) open a pipe between said new fluid tank and said hose to permit new fluid to be delivered to the vehicle;

a venturi which is connected to said compressed air tank and to said waste oil tank, and operable by a valve means to permit the user to put extra vacuum on said oil tank; and a housing portion into which said tank arrangement, said plurality or recharge ports, said control valve means and said venturi and all piping are contained.

19. The quick oil change system of claim 18, wherein said used oil tank, said new oil tank, and said compressed air tank are placed coaxially, one inside the other.

20. The quick oil change system of claim 18, wherein said hose is connected to a flexible dipstick tube.

21. The quick oil change system of claim 18, wherein said control valve means comprises a used valve and a new oil valve, said two valves being positioned adjacently and having circular disk plates attached thereto and lying generally on a same plane, each said two circular disk plates having a crescent shaped indent portion removed, such that the position of said two circular disk plates will not allow the two adjacent valves to be opened simultaneously, and said circular disk plates requiring that said used oil valve must be turned on, and then off, before said new oil valve can be turned on, and then off, to thereby control the sequence of collection of used fluid from and delivery of new oil fluid to a machine.

22. The quick oil change system of claim 18, further comprising a blocking valve to prevent loss of compressed air.

23. The quick oil change system of claim 18, wherein said inert gas is selected from the group consisting of nitrogen, carbon dioxide, and helium.

24. The quick oil change system of claim 18, further comprising a recharge station into which the portable unit is engageable, said recharge station comprising:

a recharge port engagement manifold having a number of transfer ports which are engageable with said recharge ports of said portable unit and when so engaged open up said valves of said recharge ports;

a plurality of valves for controlling flow of fluid through said plurality of transfer ports;

sources of compressed air, inert gas, vacuum, and new oil, and a container for used oil collected from said portable unit.

25. The quick oil change system of claim 24, wherein said recharge station further comprises a computer which controls a recharge sequence of said portable unit during which used oil is evacuated from the used oil tank and it is placed under vacuum, said compressed air tank is refilled with compressed air, and said new oil tank is refilled with new oil and pressurized with inert gas to ready said portable unit for reuse.

* * * * *

UNITED STATES PATENT AND TRADEMARK OFFICE

CERTIFICATE OF CORRECTION

PATENT NO. : 6,145,622
DATED : November 14, 2000
INVENTOR(S) : James E. Clark II It is certified that error appears in the above-identified patent and that said Letters Patent is hereby corrected as shown below:

Column 10,
Line 47, replace "flue" with -- fluid --.

Column 12,
Line 4, replace "used valve" with -- used fluid valve --.

Signed and Sealed this

Eighteenth Day of June, 2002

*Attest:*

*Attesting Officer*

JAMES E. ROGAN
*Director of the United States Patent and Trademark Office*